US006364167B1

(12) United States Patent
Safian et al.

(10) Patent No.: US 6,364,167 B1
(45) Date of Patent: Apr. 2, 2002

(54) PUMP DISPENSER PACKAGE

(75) Inventors: John W. Safian, Maumee; Richard R. Johnston, Toledo, both of OH (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 0 days.

(21) Appl. No.: 09/570,423

(22) Filed: May 12, 2000

(51) Int. Cl.[7] ..... B67B 5/00
(52) U.S. Cl. ..... 222/153.13; 222/321.7
(58) Field of Search ..... 222/190, 321.2, 222/321.3, 321.9, 321.7, 384, 153.13

(56) References Cited

U.S. PATENT DOCUMENTS 3,920,164 A * 11/1975 Lindsoe ..... 222/384
3,937,366 A 2/1976 Steiman
4,607,765 A 8/1986 Ruscitti
4,899,913 A 2/1990 Ruscitti et al.
5,271,530 A * 12/1993 Uehira et al. ..... 222/190
5,341,956 A 8/1994 Van Brocklin
6,073,805 A * 6/2000 Gueret ..... 222/321.9

* cited by examiner

*Primary Examiner*—Philippe Derakshani
*Assistant Examiner*—Thach H. Bui

(57) ABSTRACT

A pump dispenser package that includes a container having a cylindrical neck with an axial edge that surrounds a container outlet opening. The neck has an internal circumferential channel that extends around the neck in a plane adjacent to but spaced from the axial edge of the neck. A pump assembly has a cylindrical housing with an integrally formed radially outwardly extending flange. A flat annular adapter ring has an inner edge secured to the pump housing in abutment with the flange and an outer edge received in the internal channel in the container neck to mount the pump assembly to the container. In the preferred construction, the pump housing has a radial ledge spaced from the flange, and the inner edge of the adapter ring is captured between the ledge and the flange. The outer edge of the adapter ring preferably has an annular peripheral bead that is received by snap-fit within the channel in the container neck. The adapter ring has a flat upper surface that is coplanar with the axial edge of the neck.

12 Claims, 2 Drawing Sheets

PUMP DISPENSER PACKAGE

The present invention is directed to finger-type pump dispenser packages-, and more particularly to a package in which the pump dispenser is closely integrated with the pump container structure and profile.

BACKGROUND AND SUMMARY OF THE INVENTION

In typical finger-type pump dispenser packages, the pump mechanism and pump actuator are combined in assembly with a closure, and the closure has a skirt that is secured over an external thread or bead on the container finish. The container is typically blow molded, while the closure is typically injection molded. It is a general object of the present invention to provide a pump dispenser package, a method of making such a package, and a finger pump assembly, that eliminate the cost of injection mold tooling for the closure, and that reduce material costs and assembly costs as compared with typical finger-type pump dispenser packages as described above. Briefly stated, this is- accomplished by eliminating the separate closure, integrating the closure skirt into the container neck configuration, and integrating the pump assembly into the structure and geometry of the package container.

A pump dispenser package in accordance with a presently preferred embodiment of the invention includes a container having a cylindrical neck with an axial edge that surrounds a container outlet opening. The neck has an internal circumferential channel that extends around the neck in a plane adjacent to but spaced from the axial edge of the neck. A pump assembly has a cylindrical housing with an integrally formed radially outwardly extending flange. A flat annular adapter ring has an inner edge secured to the pump housing in abutment with the flange and an outer edge received in the internal channel in the container neck to mount the pump assembly to the container. In the preferred construction, the pump housing has a radial ledge spaced from the flange, and the inner edge of the adapter ring is captured between the ledge and the flange. The outer edge of the adapter ring preferably has an annular peripheral bead that is received by snap-fit within the channel in the container neck. The adapter ring has a flat upper surface that is coplanar with the axial edge of the neck. The container may be blow molded of suitable plastic composition, with the exterior surface of the neck contoured to simulate a closure skirt. The adapter ring is flush with the top edge of the container, so the overall package resembles a typical finger-type dispenser package, but the pump assembly is integrated into the container and cannot readily be disassembled from the container.

A pump assembly for a pump dispenser in accordance with another aspect of the invention includes a cylindrical housing with an integrally formed radially outwardly extending flange, a pump mechanism disposed in the housing, and a flat annular adapter ring having an inner edge secured to the pump housing in abutment with the flange and an outer edge for securement to a package container. The pump housing preferably has a radial ledge spaced from the flange, and the inner edge of the adapter ring is captured between the ledge and the flange. The ledge preferably has a sloping upper surface for centering the adapter ring as the adapter ring is received over the ledge, and a flat lower surface for opposed facing engagement with the upper surface of the adapter ring when the adapter ring is captured between the ledge and the flange. The adapter ring preferably has an annular peripheral bead that extends around the outer edge of the ring for securement to a container finish.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 3:
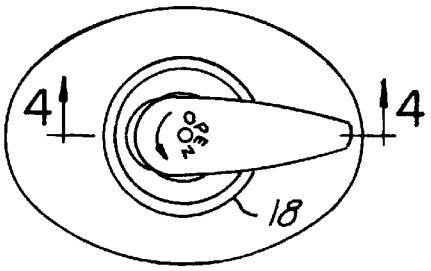
FIG. 3 is a top plan view of the package illustrated in FIG. 1.
Figure 2:
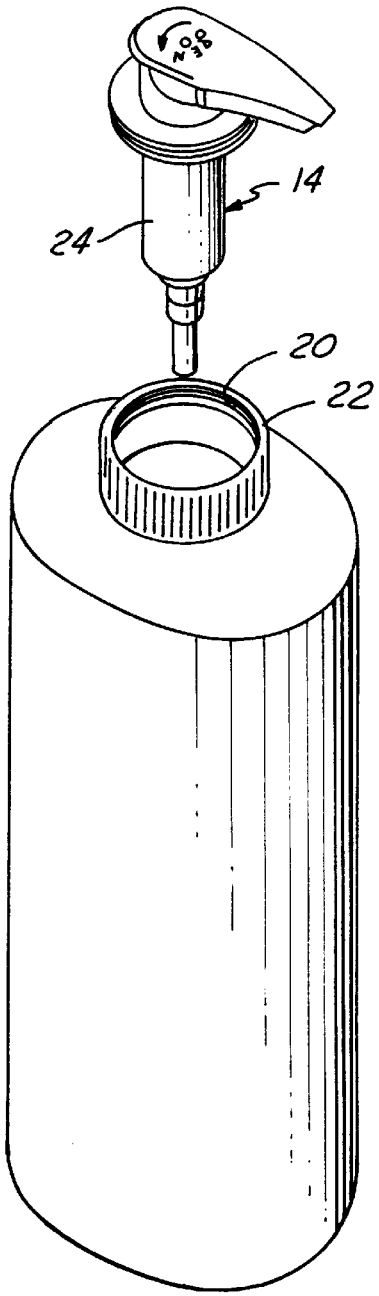
FIG. 2 is an exploded perspective view of the package illustrated in FIG. 1.

The drawings illustrate a finger-type pump dispenser package 10 in accordance with a presently preferred embodiment of the invention as comprising a molded plastic container 12 and a pump assembly 14. Container 12 has a body 16 of oval, cylindrical or other suitable geometry, which terminates in an open cylindrical finish or neck 18. The outer circumferential surface of neck 18 may be provided with axially extending corrugations or ribs that simulate the corrugations on conventional pump closures. A circumferential channel 20 extends around the interior surface of neck 18 in a plane adjacent to but spaced from the axial edge 22 of neck 18 that surrounds the container outlet opening.

Figure 1:
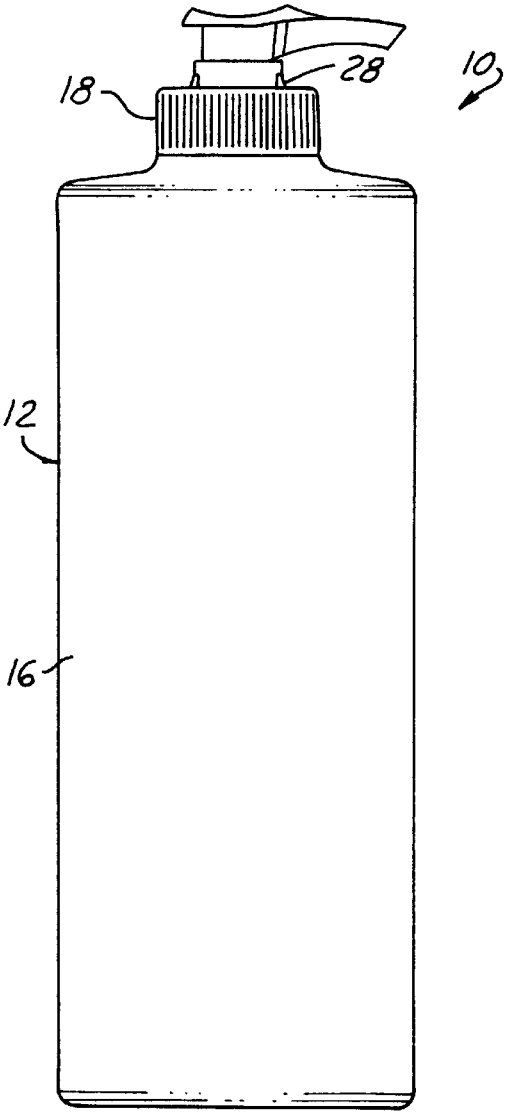
FIG. 1 is a side elevational view of a finger-type pump dispenser package in accordance with a presently preferred embodiment of the invention.
Figure 4:
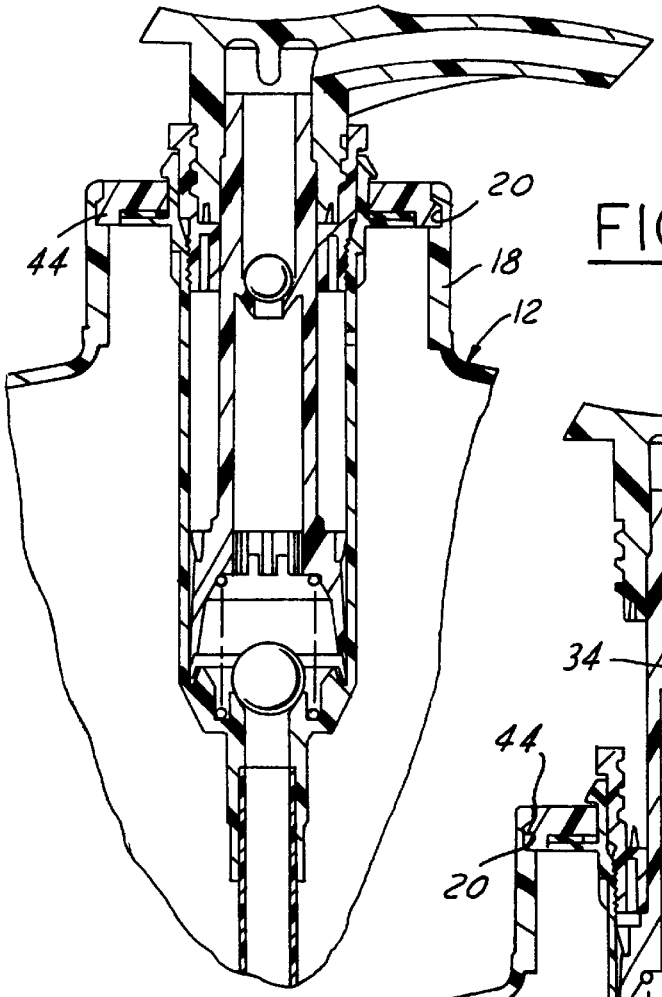
FIG. 4 is a fragmentary sectional view taken substantially along the line 4—4 in FIG. 3 showing the pump assembly in a locked down position.
Figure 5:
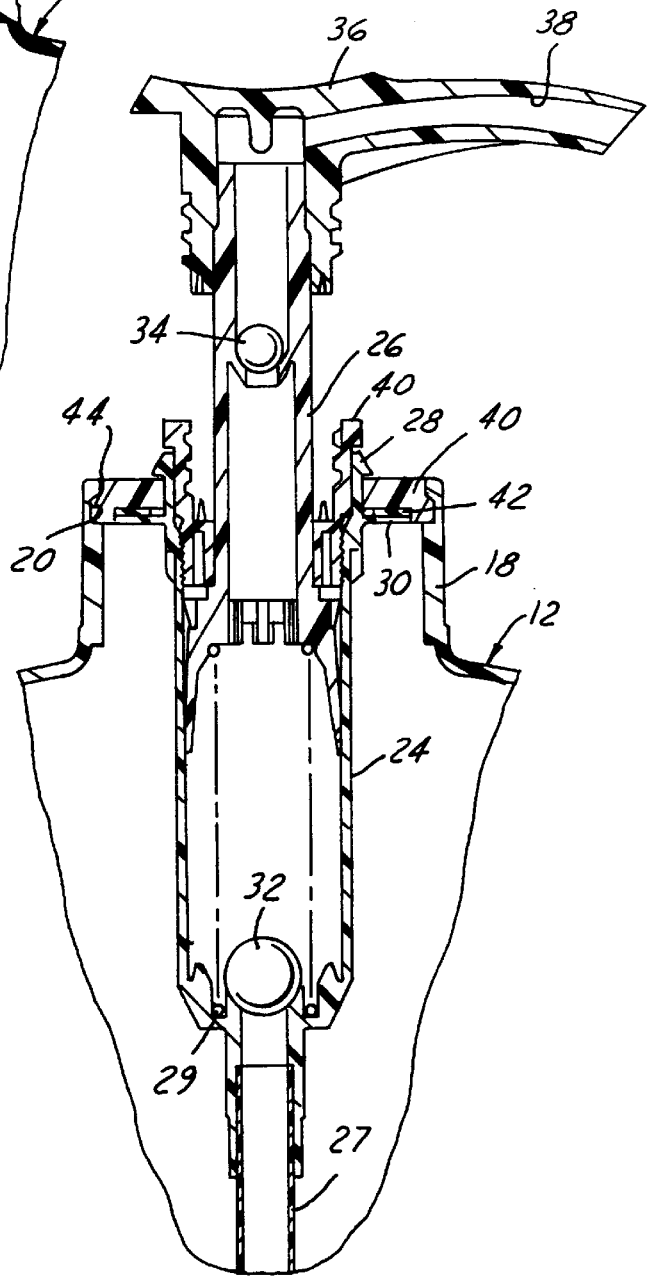
FIG. 5 is a fragmentary sectional view similar to that of FIG. 4 but showing the pump assembly extended.

Pump assembly 14 comprises a cylindrical housing 24 having an integrally formed radially outwardly extending ledge 28 around the upper edge of the housing, and an integrally formed radially outwardly extending flange 30 (FIGS. 4 and 5) axially spaced from and parallel to ledge 28. A pump mechanism is disposed within housing 24, and is of generally conventional instruction comprising a piston 26 biased upwardly by a coil spring 29. A draw tube 27 extends downwardly from housing 24 into the body of container 12 for drawing liquid from the container. A lower ball valve 32 is disposed within housing 24, and an upper ball valve 34 is disposed within the stem of piston 26. An actuator 36 is coupled to the upper end of piston 26 for actuating the pump mechanism to draw liquid from within container 12 through housing 24, piston 26 and the outlet passage 38 of actuator 36. The pump mechanism is of generally conventional construction, and is secured within housing 26 by a collar 40. Actuator 38 is externally threaded and collar 40 is internally threaded for securing the actuator to the collar for shipment in the retracted position illustrated in FIGS. 1 and 4. For use, actuator 36 is unthreaded from collar 40 as illustrated in FIG. 5.

A flat annular adapter ring 40 is captured between ledge 28 and flange 30, with a suitable seal 42 being captured in compression between ring 40 and flange 30. A conically sloping upper axially oriented surface of ledge 28 facilitates centering of ring 40 as ring 40 is assembled over the upper edge of housing 24. The lower axially facing surface of ledge 28 is flat, is disposed on a plane parallel to but spaced from flange 30, and abuts the flat upper surface of ring 40 in assembly. The inner edge of adapter ring 40 is thus captured between ledge 28 and flange 30. The outer edge of adapter ring 40 has an annular bead 44 that is captured by snap-fit within internal channel 20 in neck 18. The upper surface of adapter ring 40 preferably is flush in assembly with upper edge 22 of neck 18, so that the combination of adapter ring 40 and neck 18 simulate in appearance the closure that conventionally secures a finger-type pump assembly to a container.

There has thus been described a pump dispenser package, a pump assembly, and a method of making a pump dispenser package that fully satisfy all of the objects and aims previously set forth. The costs associated with injection mold tooling for a closure, resin material for a closure and assembly of a closure to the pump and container have been eliminated. Although the invention has been described in conjunction with a presently preferred embodiment thereof, alternatives and variations will readily suggest themselves to persons of ordinary skill in the art. The invention is intended to embrace all such modifications and variations as fall within the spirit and broad scope of the appended claims.

What is claimed is:

1. A pump dispenser package that comprises:

a container having a cylindrical neck with an axial edge that surrounds a container outlet opening, said neck having an internal channel that extends circumferentially around said neck in a plane adjacent to but spaced from said axial edge, a pump assembly having a cylindrical housing with an integrally formed radially outwardly extending flange and a radially extending ledge spaced from said flange, and a flat annular adapter ring having an inner edge secured to said pump housing in abutment with said flange, said adapter ring being captured between said ledge and said flange, and an outer edge received in said internal channel in said neck to mount said pump assembly to said container.

2. The pump set forth in claim 1 further comprising an annular seal captured between said adapter ring and said flange.

3. The pump set forth in claim 1 wherein said ledge has a conical upper surface for centering said adapter ring as said adapter ring is received over said ledge, and a flat lower surface for opposed facing engagement with an upper surface of said adapter ring.

4. The pump set forth in claim 3 wherein said flat upper surface of said adapter ring is coplanar with said axial edge of said neck.

5. The pump set forth in claim 1 wherein said adapter ring outer edge has an annular peripheral bead that is received within said channel.

6. The pump set forth in claim 1 wherein said adapter ring has a flat surface that is coplanar with said axial edge of said neck.

7. A pump assembly for a pump dispenser package, which comprises:

a cylindrical housing with an integrally formed radially outwardly extending flange and a radially extending ledge spaced from said flange, a pump mechanism disposed in said housing, and a flat annular adapter ring having an inner edge secured to said pump housing in abutment with said flange and an outer edge for securement to a package container, said inner edge of said adapter ring being captured between said ledge and said flange.

8. The pump assembly set forth in claim 7 comprising an annular seal captured between said adapter ring and said flange.

9. The pump assembly set forth in claim 7 wherein said ledge has a conical upper surface for centering said adapter ring as said adapter ring is received over said ledge, and a flat lower surface for opposed facing engagement with an upper surface of said adapter ring.

10. The pump assembly set forth in claim 7 wherein said adapter ring outer edge has an annular peripheral bead for securement to a container.

11. A method of making a pump dispenser package that comprises the steps of:

(a) providing a container having a cylindrical neck with an axial edge that surrounds a container outlet opening, said neck having an internal channel that extends around said neck in a plane spaced from said edge, (b) providing a pump assembly that includes a cylindrical housing containing a pump mechanism, an integrally formed radially outwardly extending flange and a edge on said housing spaced from said flange, and a flat annular adapter ring having an inner edge secured to said pump housing in abutment with said flange and an outer edge, including (b1) providing said housing and said adapter ring as separate components, and then (b2) securing said adapter ring on said housing over said ledge such that said ring is received by snap fit between said ledge and said flange, and (c) securing said pump assembly within said neck with said outer edge of said adapter ring being received by snap fit within said channel in said neck.

12. The method set forth in claim 11 wherein said step (b1) comprises providing an annular peripheral bead on said outer edge of said adapter ring, and wherein said step (c) comprises securing said bead within said channel.

* * * * *